US006217092B1

(12) United States Patent
Spicker

(10) Patent No.: US 6,217,092 B1
(45) Date of Patent: Apr. 17, 2001

(54) FOOD TONGS, IN PARTICULAR ICE TONGS

(76) Inventor: Harald Spicker, Resthofstrasse 41,A-4400, Steyr (AT)

( * ) Notice: Subject to any disclaimer, the term of this patent is extended or adjusted under 35 U.S.C. 154(b) by 0 days.

(21) Appl. No.: 09/486,306

(22) PCT Filed: Aug. 12, 1998

(86) PCT No.: PCT/AT98/00188

§ 371 Date: Feb. 24, 2000

§ 102(e) Date: Feb. 24, 2000

(87) PCT Pub. No.: WO99/09870

PCT Pub. Date: Mar. 4, 1999

(30) Foreign Application Priority Data

Aug. 25, 1997 (AT) ..... 1422/97

(51) Int. Cl.[7] ..... A47G 21/10; A47J 43/28

(52) U.S. Cl. ..... 294/16; 294/99.2

(58) Field of Search ..... 294/3, 7, 8, 8.5, 294/11, 16, 25, 28, 33, 99.2, 106; 30/142, 147, 150, 322; D7/643, 683, 686

(56) References Cited

U.S. PATENT DOCUMENTS

| | | | | |
|---|---|---|---|---|
| 1,775,571 | * | 9/1930 | Romer | 294/99.2 X |
| 2,670,234 | * | 2/1954 | Roop | 294/99.2 |
| 2,674,793 | * | 4/1954 | Dominick | 294/3 X |
| 2,994,553 | * | 8/1961 | Banton | 294/7 X |
| 3,259,415 | * | 7/1966 | Howard | 294/33 X |
| 3,356,405 | * | 12/1967 | Gruber | 294/3 |
| 3,596,965 | * | 8/1971 | Woofter | 294/7 X |
| 4,802,704 | * | 2/1989 | Burns | 294/99.2 |
| 5,054,835 | | 10/1991 | Loechel et al. . | |
| 5,199,756 | * | 4/1993 | Bartlett et al. | 294/99.2 X |

FOREIGN PATENT DOCUMENTS

| | | |
|---|---|---|
| 37 05 570 | 3/1988 | (DE) . |
| 40 40 730 | 6/1992 | (DE) . |
| 1104919 | 3/1968 | (GB) . |

* cited by examiner

*Primary Examiner*—Johnny D. Cherry
(74) *Attorney, Agent, or Firm*—Collard & Roe, PC

(57) ABSTRACT

A pair of food tongs (1) comprises two legs (2, 3) of the tongs each forming a gripper portion (21, 31) and a stalk portion (22, 32), which in the end portion of the stalk portions (22, 32) facing away from the gripper portion are pivotally mounted at each other so as to be relatively movable about a transverse axis (Q) in a stop-limited way and are spring-loaded in the opening sense of the gripper portions (21, 31). To obtain a pair of tongs which is functionally reliable, easy to clean and economic to produce, the two legs (2, 3) of the tongs made of plastics have meshing hinge flaps (4, 5) with bearing lugs (41) on the one hand and bearing pins (51) snapping into the bearing lugs (41) on the other hand, and at least at one leg (2) of the tongs in the vicinity of the stalk portion a spring tongue (6) is molded, which projects towards the other leg (3) of the tongs at an acute angle.

1 Claim, 1 Drawing Sheet

FOOD TONGS, IN PARTICULAR ICE TONGS

This invention relates to a pair of food tongs, in particular a pair of ice tongs, comprising two legs of tongs each forming a gripper portion and a stalk portion, which legs are pivotally mounted at each other in the end portion of the stalk portions facing away from the gripper portion so as to be relatively movable about a transverse axis in a stop-limited way.

Such tongs are used for handling foodstuffs such as ice cubes, pieces of sugar, but also sausage, pastries and the like, where the legs of tongs have so far mostly been held together via a separate hinge with hinge pins and have been spring-loaded via a leg spring put onto the hinge pin. Due to the different individual parts of such tongs the manufacture thereof is rather complex and creates difficulties in cleaning the same above all in the hinge and spring area. The same is true for an eating utensil known from DE 40 40 730 A, comprising two oblong elements which are pivotally mounted at each other via a joint and each have a receiving portion and an actuating portion, where the one element constitutes a spoon and the other one constitutes a stalked ring adapted to the spoon, so that the foodstuffs picked up with the same, in particular spaghetti, can be cut into lengths by pressing the elements together. Spoon bowl and ring cooperate in the manner of shears, and a spring tongue fixed at one of the elements serves as opening spring.

Moreover, there already exist one-piece tongs, where the legs of such tongs are connected with each other by a spring clip in the vicinity of the ends of the stalk portions, so that because of the risk of material fatigue of the spring clip the entire tongs must consist of a high-quality spring material, or the function of the tongs remains unsatisfactory due to the poor spring properties, and a correspondingly high risk of breakage must be accepted.

It is therefore the object underlying the invention to create a pair of food tongs as described above, which with a comparatively simple and inexpensive manufacture is characterized by its longevity and functional reliability and last but not least is good and easy to clean.

This object is solved by the invention in that the two legs of the tongs made of plastics have meshing hinge flaps with bearing lugs on the one hand and bearing pins snapping into the bearing lugs on the other hand, and at )east at one leg of the tongs in the vicinity of the stalk portion there is molded a spring tongue known per se, which projects towards the other leg of the tongs at an acute angle. By means of these measures, the tongs can be composed of two components, which may each be made of plastics in one piece, for instance by an injection molding process, where these components comprise the gripper and stalk portions of the legs of the tongs, but also the hinge portions for pivotally mounting them at each other and the spring tongue for spring loading. These two components, which can be prefabricated in an economic way, need only be pressed together so that the hinge pins and bearing lugs of the meshing hinge flaps can snap into each other, and the pair of tongs is ready for operation. As material, any suitable food-compatible plastic material may be used, the spring tongue is hardly liable to ageing due to the favorable load conditions and the inherent elastic properties of the plastic material, and the one-piece design of the legs of the tongs and their simple shape as well as the permanent decomposability of the tongs provide optimum possibilities for cleaning.

When the one hinge flaps with the bearing lugs and the bearing pins of the other hinge flaps have inclined stop faces adjusted to each other, pressing the hinge flaps together for composing the legs of the tongs is facilitated and simplified, as due to their wedge action the inclined stop faces at the same time involve a lateral bending up of the flaps until the bearing pins snap into the bearing lugs, when the hinge flaps are pressed together.

In the drawing, the subject-matter of the invention is illustrated in detail with reference to an embodiment, wherein.

Figure 1:
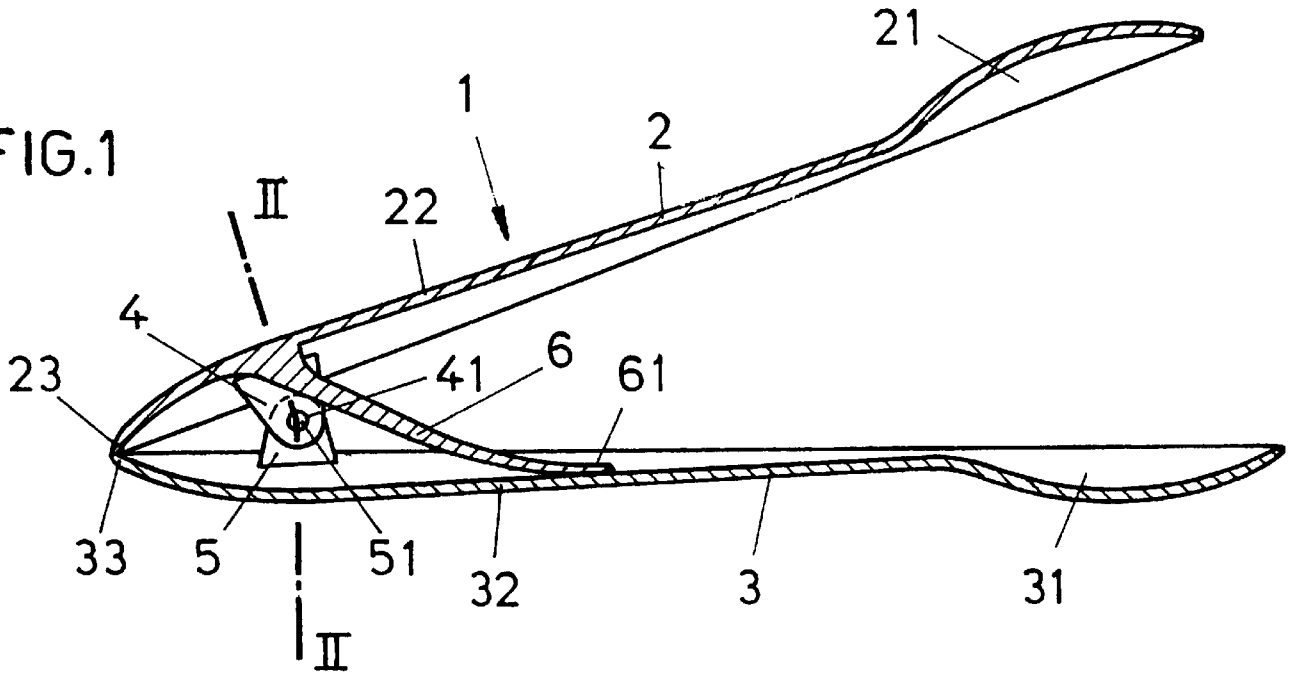
FIG. 1 shows a pair of inventive food tongs in a longitudinal section.
Figure 2:
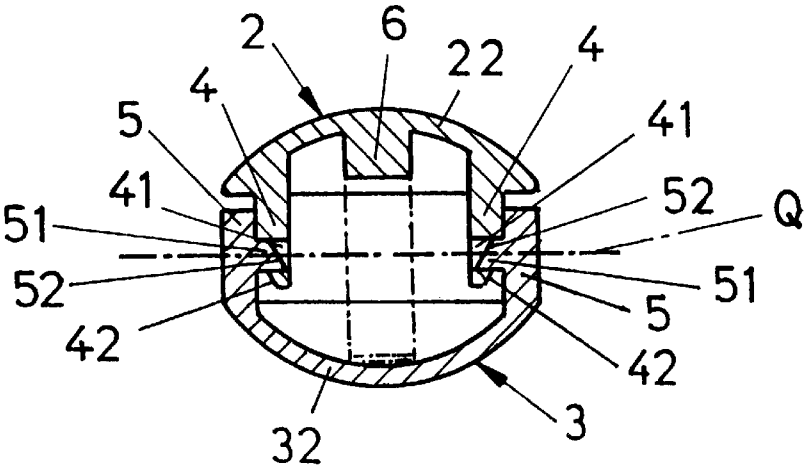
FIG. 2 shows a cross-section along line II—II of FIG. 1 on a larger scale.

A pair of food tongs 1 has two legs of tongs 2, 3 each made of plastics in one piece, which each form a gripper portion 21, 31 and a stalk portion 22, 32, and in the end portion of the stalk portions 22, 32 facing away from the gripper portion are pivotally mounted at each other so as to be relatively movable about a transverse axis Q. For pivotal mounting, each leg 2, 3 of the tongs has hinge flaps 4, 5 engaging in each other, where the hinge flaps 4 have bearing lugs 41, and the hinge flaps 5 have bearing pins 51 snapping into the bearing lugs 41. To facilitate such snapping together, the hinge flaps 4 are provided with an inclined stop face 42 at their freely protruding upper surface, and the bearing pins 51 are provided with an inclined stop face 52 at their end face, which stop faces are adjusted to each other.

The legs 2, 3 of the tongs are spring-loaded in the opening sense of the gripper portions 21, 31, for which purpose at the leg 2 of the tongs a spring tongue 6 is molded in the stalk portion 22, which spring tongue projects from the leg 2 of the tongs at an acute angle and with its tongue tip 61 is supported at the leg 3 of the tongs under a bending bias. Spring tongues might actually be molded at both legs of the tongs, which spring tongues are then mutually or alternately supported at the respective other leg of the tongs, which possibly leads to an increase of the spring load. In most cases, one spring tongue is, however sufficient.

Due to the spring load, the two legs 2, 3 of the tongs will open in the rest position about the transverse axis Q, until the ends 23, 33 of the stalk portions 22, 32 rest against each other as limit stops and the two gripper portions 21, 31 are ajar. By means of a slight pressure with the hand holding the food tongs on the two legs 2, 3 of the tongs, the gripper portions 21, 31 are swivelled towards each other against the force of the spring tongue 6 and allow the sensitive gripping of foodstuffs with the tongs. A decrease in pressure leads to an automatic opening of the tongs 1 and to the foodstuffs seized being released.

What is claimed is:

1. A pair of food tongs comprising two legs made of plastics, each leg having a gripper portion and a stalk portion, the legs being pivotally connected to each other at an end of the stalk portions facing away from the gripper portions so as to be relatively movable about a transverse axis in a stop-limited way by meshing hinge flaps on the legs, one of the hinge flaps having bearing lugs and the other hinge flap having bearing pins snapping into the bearing lugs, the bearing lugs and the bearing pins having inclined stop faces conforming to each other, and the gripper portions being spring-loaded in an opening sense by a spring tongue molded to the stalk portion of one of the legs and projecting towards the other leg at an acute angle.

* * * * *